US007944396B2

(12) United States Patent
Brown et al.

(10) Patent No.: US 7,944,396 B2
(45) Date of Patent: May 17, 2011

(54) RETRODIRECTIVE TRANSMIT AND RECEIVE RADIO FREQUENCY SYSTEM BASED ON PSEUDORANDOM MODULATED WAVEFORMS

(75) Inventors: Elliott R. Brown, Glendale, CA (US); Rodney F. Sinclair, Thousand Oaks, CA (US)

(73) Assignee: Physical Domains, LLC

( * ) Notice: Subject to any disclaimer, the term of this patent is extended or adjusted under 35 U.S.C. 154(b) by 989 days.

(21) Appl. No.: 11/757,324

(22) Filed: Jun. 1, 2007

(65) Prior Publication Data

US 2011/0084879 A1 Apr. 14, 2011

Related U.S. Application Data

(60) Provisional application No. 60/922,462, filed on Apr. 9, 2007.

(51) Int. Cl.
*H01Q 1/00* (2006.01)

(52) U.S. Cl. ..... 342/370

(58) Field of Classification Search ..... 342/370
See application file for complete search history.

(56) References Cited

U.S. PATENT DOCUMENTS

2002/0128027 A1* 9/2002 Wong et al. ..... 455/513
2006/0166681 A1* 7/2006 Lohbihler ..... 455/456.2

* cited by examiner

*Primary Examiner* — Thomas H Tarcza
*Assistant Examiner* — Harry Liu
(74) *Attorney, Agent, or Firm* — Dennis R. Smalley

(57) ABSTRACT

Embodiments provide radio-frequency systems that can automatically detect, focus-on, and track objects in the environment without the need for expensive electronic scanning and phase-shifting components. Some embodiments are directed to retrodirective systems including: (1) quiescently broadcast pseudorandom-modulated radiation, such as pseudorandom bit sequences, in the absence of a target, over a field-of-view comparable to the beam solid angle of a single element in the transmit array; (2) a receive antenna element or array, in a desired spatial relationship with respect to the transmit antenna array, that receives reflected pseudorandom radiation from a target; and (3) an electronic signal-processing and feedback channel between the receive and transmit arrays that carries out cross-correlation between the received radiation and the transmitted pseudorandom signals and computes complex correlation coefficients to form a re-transmitted beam. Some embodiments are useful for short-range applications involving small and fast moving targets.

12 Claims, 11 Drawing Sheets

RETRODIRECTIVE TRANSMIT AND RECEIVE RADIO FREQUENCY SYSTEM BASED ON PSEUDORANDOM MODULATED WAVEFORMS

RELATED APPLICATIONS

This application claims benefit of U.S. Provisional Application No. 60/922,462 filed Apr. 9, 2007. This referenced application is incorporated herein by reference as if set forth in full herein.

US GOVERNMENT RIGHTS

A portion of the inventions disclosed and potentially claimed herein were made with Government support under Contract Number W911NF-05-C-0106. The Government has certain rights. Not all inventions disclosed herein were developed or conceived with government funding and it is not intended that the government attain rights in such inventions.

FIELD OF THE INVENTION

The present invention relates generally to electromagnetic radiation transmission and detection methods and apparatus related to a retrodirective antenna configuration, a "retrodirective" functionality, and a target detection capability. In the present context, "retrodirective" means that the radiation collected by the system receiver is used by the system to automatically transmit new radiation in the same direction as the target that creates the reflection. Certain embodiments of the invention also relate to the waveform generation and signal processing methods associated with digital and analog pseudorandom waveforms at radio frequencies, particularly the generation and reception of such waveforms using high frequency antennas and antenna arrays.

BACKGROUND OF THE INVENTION

Various teachings about active retrodirective systems have been described in prior publications. The teachings of the present application can be better understood with reference to these prior publications:

(1) L. C. Van Atta, U.S. Pat. No. 2,908,002, 1959
(2) S. N. Andre and D. J. Leonard, IEEE Trans. Ant. and Prop., March 1964, pp. 181-186
(3) C. Y. Pon, IEEE Trans. Ant. and Prop., March 1964, pp. 176-180.
(4) P. Horowitz, and W. Hill, "The Art of Electronics", Cambridge University Press, 1980.
(5) S. Haykin, "Communication Systems" 3rd Ed. (John Wiley, New York, 1994), Sec. 2.8.
(6) J. W. Goodman, "Introduction to Fourier Optics, 2nd Ed (McGraw Hill, New York, 1996).
(7) R. Y. Miyamoto, Y. Qian, and T. Itoh, IEEE 1999 MTT-S Digest, pp. 655-658.
(8) L. D. DiDomenico, and G. M. Rebeiz, IEEE Trans on Microwave Theory & Tech, vol. 49, no. 4, pp. 677-84 (2001)
(9) M. Dawood, and R. M. Narayanan, IEEE Trans on Aero & Electronic Systems, vol. 37, no. 2, April 2001, pp. 586-94
(10) B. Y. Toh, V. F. Fusco, and N. B. Buchanan, IEEE Trans Ant. and Prop, vol. 50, no. 10, pp. 1425-1432, October 2002
(11) S. Gupta and E. R. Brown, 2003 IEEE MTT-S Digest (IEEE, New York, 2003), pp. 599-603 (2003).

(12) E. R. Brown, A. G. Cotler, A. Umali, and S. Gupta, 2004 IEEE MTT-S Digest, pp. 751-754. [2004].
(13) E. B. Brown and E. R. Brown, IEEE 2005 IMS Digest, paper TH3B-3.
(14) E. R. Brown, "Retrodirective Noise Correlating Radar: Methods and Apparatus," U.S. patent application Ser. No. 11/043,745, 2005.

Each of these publications is incorporated herein by reference as if set forth in full herein.

Various retrodirective system methods and apparatus have been used or proposed in the past. A retrodirective antenna array for use as an electromagnetic reflector was described by Van Atta in 1959, in U.S. Pat. No. 2,908,002, using feedhorn-type antennas. Van Atta showed how the arrangement of transmit and receive antenna arrays should occur symmetrically about a geometric center point, and how the retrodirective re-transmission of received radiation would occur automatically if the time delay between the symmetric pairs was equal. However, the teachings of Van Atta were strictly directed to a passive reflector component for use in radar or communications. Van Atta did not address the integration of the retrodirective array to form a radar or communications system by the addition of active (gain) electronics between each receive antenna element and the symmetric transmit element.

Electronic gain and other components were first added to each channel of Van-Atta retrodirective antenna arrays in the early 1960s, and applied to various communications systems, particularly for satellites [S. N. Andre and D. J. Leonard, IEEE Trans. Antennas and Propagation, March 1964, pp. 181-186]. The primary application was in transponders whereby the satellite system retransmits the incident signal in the same direction from where it originated but with amplified power and, perhaps, an offset carrier frequency.

It was recognized early on that the Van Atta array was somewhat impractical for communications because it requires separate receive and transmit antennas. So an alternative type of retrodirective system was proposed and demonstrated by C. Y. Pon [IEEE Trans. Antennas and Propagation, March 1964, pp. 176-180] that required only one antenna for receive and transmit. It utilized a heterodyne electronic channel connecting the common transmit/receive antenna. Retrodirectivity is achieved by multiplying the incoming signal against a local oscillator at twice the frequency of the signal.

The 1970s and 80s saw very little advancement in the technology or application of retrodirective antennas in RF systems. In the 1990s, interest was rejuvenated with advancements in microwave integrated circuits and semiconductor devices that allowed planar antennas (e.g., patches) to be combined with mixers and local oscillators in very efficient and compact circuits and systems. This work was aimed at communications applications, and implemented primarily the Pon retrodirective technique summarized above.

In 2002 research began at UCLA in the application of retrodirective antennas toward a radar system. The initial idea was to use the Van Atta architecture since it provides much greater isolation between transmit and receive than the Pon architecture, and radar generally requires much more isolation than a communications system. One array was designed to transmit and the other array to receive. Additive white Gaussian noise (AWGN) was investigated first because of its prevalence in all electronics.

The retrodirective noise correlating (RNC) radar was first analyzed in 2003 [Gupta and Brown, 2003] and then demonstrated in 2004 [Brown, Cotler and Gupta] in the S band. Its key feature was direct RF feedback between the receive and transmit arrays of a Van-Atta antenna configuration. This allowed for ultrafast detection of targets on a time scale corresponding to a few round trips through free space. Target angle was determined by cross-correlation between neighboring antennas, just as in radio astronomy receivers. Some features of this initial attempt at a retrodirective noise correlating (RNC) system were set forth in U.S. patent application Ser. No. 11/043,745, now abandoned.

While representing the first known application of a retrodirective active antenna to target sensing, the RNC system was fraught with problems that precluded its application in practical systems. First, it was observed early on that the RNC system could not distinguish real targets from stationary clutter. This is because of its inherent incoherence and, therefore, its inability to distinguish targets based on motion and the associated Doppler shift in the frequency domain.

A second problem with the RNC system was its inability to unambiguously determine target range.

A third problem with the RNC system was its limited spatial resolution, determined by the element-to-element spacing rather than the entire antenna aperture. This was a result of the incoherence of the detection process by which the absolute phase of the incoming waveform was not determined.

Because of these shortcomings, a need still exists to create an active retrodirective system that can provide range and bearing estimation, and also rejection of stationary clutter, and thus allowing such systems to function as effective radar. These needs are especially important for short range applications that can automatically detect, track, and acquire a target without the need for a separate sensor to provide cueing.

A need also exists in the field for sensors that can detect very small targets, such as ballistic projectiles, moving very fast and at close range. In such systems, the detection and acquisition times of the radar must be short compared to the time-of-flight of such projectiles.

SUMMARY OF THE INVENTION

It is an object of at least some embodiments of the invention to provide improved retrodirective transmit-receive apparatus and methods to transmit radiation over a wide angle in space in the absence of a target (i.e., search), and automatically transform the broad beam into a narrow beam of equal total power in the presence of a target.

It is an object of at least some embodiments of the invention to provide improved retrodirective transmit-receive apparatus and methods that can automatically steer the focused beam toward the target as it moves through space, thus track the target.

It is an object of at least some embodiments of the invention to provide improved retrodirective transmit-receive apparatus and methods capable of carrying out the search-and-track function with a multiple-element transmit antenna array and a separate multiple-element receive antenna array. It is an object of at least some embodiments of the invention to provide improved retrodirective transmit-receive apparatus and methods capable of carrying out the search-and-track function with pseudorandom modulated transmit waveforms.

It is an object of at least some embodiments of the invention provide improved retrodirective transmit-receive apparatus and methods capable of processing the pseudorandom modulated waveforms from each antenna of the receive array by coherent and linear correlative signal processing using the known transmitted waveforms as the basis for cross-correlation. It is an object of at least some embodiments of the invention to use the resulting correlation coefficients to focus and steer subsequent radiation from the transmit antenna array, consistent with the retrodirective condition.

It is an object of at least some embodiments of the invention to provide improved retrodirective transmit-receive apparatus and methods capable of uniquely determining the target range and angle (i.e., target bearing), and rejection of stationary clutter, based on linear, coherent processing of the pseudorandom waveforms.

It is an object of at least some embodiments of the invention to provide improved retrodirective transmit-receive apparatus and methods capable of functioning as a search-and-track radar system with fast target detection and acquisition time, roughly between 10 microseconds and 10 milliseconds depending on the size, range, and velocity of the target.

It is an object of at least some embodiments of the invention to provide improved retrodirective transmit-receive apparatus and methods capable of functioning as a short range radar system that allows one or more of automatic detection, tracking, and acquisition of targets without the need for separate cuing.

It is an object of at least some embodiments of the invention to provide improved retrodirective transmit-receive apparatus and methods capable of functioning as radar systems that allow improved detection of very small (e.g., as small as 1 square inch) targets, that are at close range (e.g. in the range of 3 to 100 m, or even 100 to 200 m) and that are moving very fast [e.g., at speeds roughly from 10 m/s to 330 m/s (Mach I) and above].

It is an object of at least some embodiments of the invention to provide improved retrodirective transmit-receive apparatus and methods capable of functioning as three-dimensional RF imaging systems operating over a field-of-view comparable to the beam solid angle of an individual element of the transmit or receive arrays.

Other objectives and advantages of various embodiments and aspects of the invention will be apparent to those of skill in the art upon review of the teachings herein. The various embodiments or aspects of the invention, set forth explicitly herein, or otherwise ascertained from the teachings herein, may address one or more of the above objectives alone or in combination, or alternatively may address some other objective of the invention. It is not necessarily intended that all objectives be addressed by any single aspect of the invention, even though that may be the case with regard to some aspects.

A first aspect of the invention provides a transmitter containing one or more radiating elements, each driven by a pseudorandom modulated (PRM) waveform that is unique and quasi-orthogonal with respect to the PRM waveform from all other elements of the transmit array, such that in the absence of a target the transmitted beam fluctuates over space and time but stays within a beam angle equal to that of an individual element in the transmit array.

A second aspect of the invention provides a receive antenna array containing two or more elements, and an electronic channel, interconnecting each receive element to a specific transmit element, the electronic channel designed to compute complex feedback coefficients by cross correlating the signal from each receive element against the entire set of transmitted PRM waveforms.

A third aspect of the invention utilizes the feedback coefficients computed in the electronic channels to modify the waveform from each transmit element so as to create a high degree of temporal correlation between neighboring transmit elements, and thus focus and steer the transmitted beam on and towards the target.

A fourth aspect of the invention utilizes the coherence and linearity of the receiver PRM waveform signal processing to determine in real time the target bearing, angle and range, and also determine the target velocity vector.

A fifth aspect of the invention provides a transmit and receive electromagnetic apparatus, including: (1) a transmit antenna array having a one or more antenna elements, each configured to transmit radiation into space, (2) a receive antenna array having a plurality of receive elements with specific locations relative to the transmit element or elements; and (3) RF digital or analog electronic components that drive each transmit element with a pseudorandom modulated (PRM) waveform that is unique and quasi-orthogonal with respect to the other PRM waveforms when there is more than one transmit element in the array.

A sixth aspect of the invention provides a transmit and receive electromagnetic apparatus, including: (1) transmit and receive antenna arrays with the transmit array having one or more elements, each transmitting a unique and quasi-orthogonal PRM waveform in the absence of a target, and wherein each transmit element has a corresponding receive element in the receive antenna array, and (2) an electronic channel interconnecting each receive-transmit element pair through an electronic channel that generates complex feedback coefficients for the transmit elements by cross correlating the signal from each receive element against a set of one or more transmitted PRM waveforms.

A seventh aspect of the invention provides a transmit and receive electromagnetic apparatus, including: (1) transmit and receive antenna arrays, respectively, having transmit elements radiating PRM waveforms and receive elements coherently processing those waveforms, and (2) an electronic channel interconnecting each receive element to a corresponding transmit element to form a feedback loop that, in the presence of a target, utilizes cross correlation and linearity to create a high degree of temporal correlation in the signal between the transmit elements such that a focusing and steering of the transmitted radiation occurs on and toward the target.

An eighth aspect of the invention provides a transmit and receive electromagnetic method, including: (1) transmitting radiation into space using a transmit antenna array comprising one or more transmit elements; and (2) receiving reflected transmitted radiation back from a target, when present, using a receive antenna array having a plurality of receive elements with specific locations relative to the transmit element or elements; wherein the transmitted radiation has a pseudorandom modulated (PRM) waveform that was created.

In a variation of the eighth aspect of the invention, the one or more transmit elements includes a plurality of transmit elements with each being respectively matched to one or more of the receive elements and wherein the pseudorandom modulated (PRM) waveform from each transmit element is unique and quasi-orthogonal with respect to the PRM waveforms from all other transmit elements of the transmit array. In a further variation, the one or more transmit elements comprise a plurality of N transmit elements, where N is an integer, and where the plurality of receive elements comprise N receive elements and wherein there is a one-to-one pairing of transmit and receive elements. In a still further variation the method additionally includes generating complex feedback coefficients for use in deriving transmit signals for each transmit element by cross correlating signals from each receive element against a set of transmitted PRM waveforms associated with of one or more or the transmit elements. In another variation, the matching includes use of RF electronic components and wherein the receive elements and their associated RF electronic components coherently process reflected and received signals and wherein the RF electronic components interconnect each receive element to a corresponding transmit element to form an electronic feedback channel, and wherein, in the presence of a target, using cross correlation and linear superposition to create a high degree of temporal correlation in the signals between the transmit elements such that a focusing and steering of the transmitted radiation occurs on and toward the target.

Further aspects of the invention will be understood by those of skill in the art upon review of the teachings herein. These other aspects of the invention may involve methods that can be used in combination with the apparatus aspects of the invention as set forth above or in combination with other apparatus. Further aspects of the invention may provide various combinations of the aspects, embodiments, and associated alternatives set forth herein, alone or combination with the materials incorporated herein by reference, as well as provide other configurations, structures, functional relationships, and processes that have not been specifically set forth above.

DETAILED DESCRIPTION OF PREFERRED EMBODIMENT

The preferred embodiment of the present invention is an active retrodirective transmit-receive system having a transmit waveform that provides the following characteristics: (1) a "stochastic" transmit beam that automatically fluctuates over the field-of-view (defined by the single-element beam pattern of a planar antenna array) without phase shifters or other electronic beam scanning devices, and (2) a determinism and phase coherence that can be used to carry out the signal processing and target acquisition functions of a modern radar including detection, range, bearing, and acquisition. Specifically, the waveform behaves in a random fashion over a time scale comparable to the inverse RF bandwidth of the system, but a deterministic fashion over a longer time scale [at least one round-trip time through free space] to provide for coherent signal processing in the receiver.

The preferred embodiment of the present invention employs pseudorandom modulated (PRM) waveforms. In some cases, such PRM waveforms may take on the form of pseudorandom bit sequences (PRBSs) imposed on a coherent carrier while tailored correlative signal processing may be used in the receiver electronics. Other pseudorandom waveforms are believed possible, e.g. "scrambled" bitstreams based on pseudorandom polynomial representations.

The preferred embodiment of the present invention uses different pseudorandom waveforms that operate over the same RF band but are quasi-orthogonal. In the present context, quasi-orthogonal means that the time-domain cross correlation of one pseudorandom waveform against a second, quasi-orthogonal pseudorandom waveform is approximately zero, although it may never be exactly zero.

The preferred embodiment of the present invention uses a unique quasi-orthogonal, pseudorandom waveform in each transmit element of the transmit antenna array to radiate a "stochastic" beam in the absence of a target that is limited in solid angle to the beam pattern from a single element of the transmit array.

In the preferred embodiment of the present invention the transmit antenna is an array of M (a positive integer) elements, and the receive antenna is an array of N (a positive integer) elements, satisfying the following conditions: $M \geqq 1$, $N \geqq 2$, and $N \geqq M$. The transmit array can be zero-, one-, or two-dimensional (zero dim being a single element). The receive array can be one- or two-dimensional.

The preferred embodiment of the present invention connects a single receive element to a single transmit element through analog and digital electronic channels whose function is, in the presence of a target, to automatically focus the transmit beam to a much smaller beam solid angle than transmitted by a single transmit element with or without a target present. The accuracy of the beam steering improves with the number of elements in the transmit and receive arrays.

Figure 1:
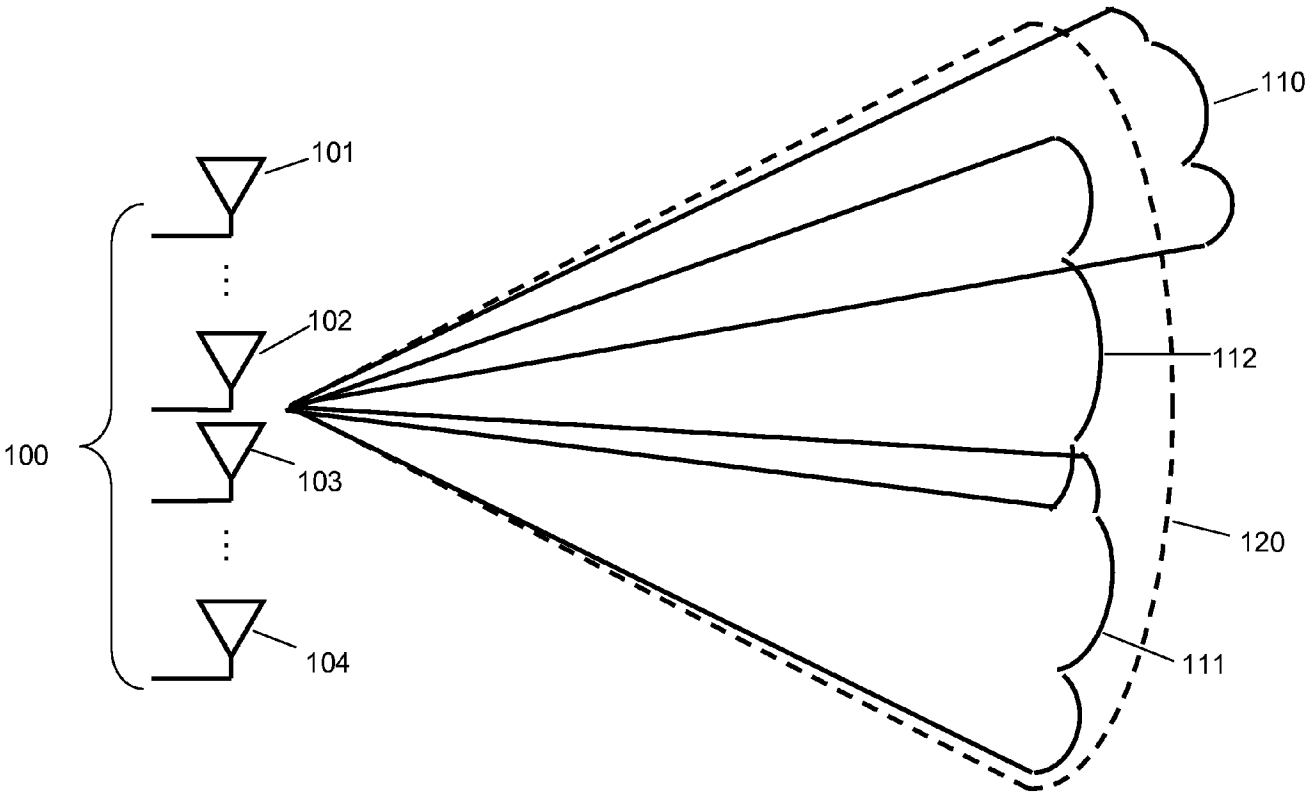
FIG. 1 illustrates the behavior of the radiated beam from a sample transmit antenna array in the absence of a target according to one embodiment of the invention.

FIG. 1 illustrates the behavior of the radiated beam from a sample M-element transmit antenna array 100 according to the preferred embodiment of the invention in the absence of a target. FIG. 1 shows a first element 101, an $M^{th}$ element 104, and two intermediate elements 102 and 103. Also shown is a "stochastic beam" radiated from the array at three successive times 110, 111, and 112, in the absence of a target. The "stochastic beam" fluctuates in space and time because each transmit element is driven with a separate quasi-orthogonal pseudorandom-modulated (PRM) waveform. However, when averaged over time, the stochastic beam remains within the beam solid angle of a single element of the transmit array 120, so that any target located within this angle and having sufficiently large radar cross section will create a reflected signal.

Figure 2:
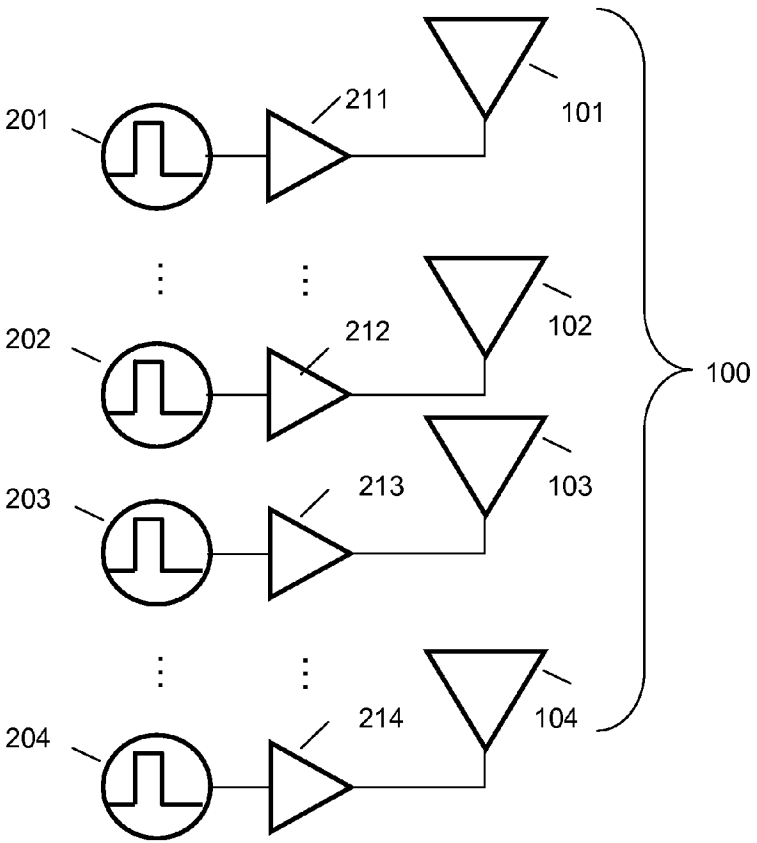
FIG. 2 illustrates of a method of producing the beam behavior of FIG. 1 based on transmitting a unique pseudorandom-modulated (PRM) waveform from each transmit element of the transmit antenna array.

FIG. 2 provides a schematic diagram of a method of producing the beam behavior of FIG. 1 based on transmitting a unique pseudorandom-modulated (PRM) waveform from each element of the transmit antenna array. Each of the M elements 101-104 of the transmit array 100 is driven by a unique quasi-orthogonal PRM waveform 201 to 204, respectively. In the present context "quasi-orthogonal" means that the time-domain cross correlation between the PRM waveforms from any pair of transmit elements will be zero or close to zero when taken over a time much greater than the inverse PRM bandwidth or the inverse antenna bandwidth. To preserve quasi-orthogonality, it is important to maintain linearity through the transmit process. So the PRM generation is isolated from the antenna by power or buffer amplifiers 211 to 214.

Figure 3:
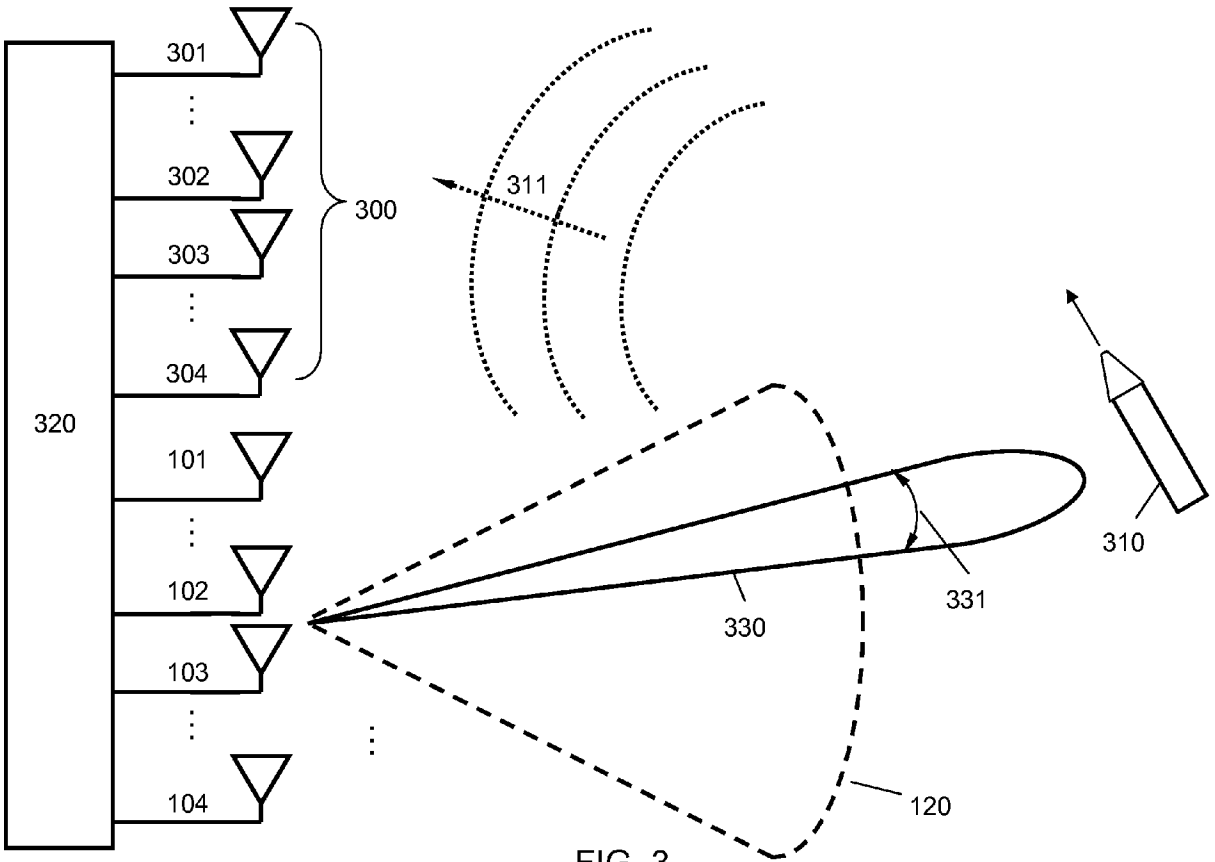
FIG. 3 illustrates a radiated beam from a sample transmit antenna array of an embodiment of the invention in the presence of a target showing a focusing of the beam in the direction of the target after reception and re-transmission.

FIG. 3 illustrates a radiated beam from a sample transmit antenna array of an embodiment of the invention in the presence of a target, showing a focusing of the beam in the direction of the target after reception and re-transmission. In FIG. 3 a broad transmit beam 120 focuses to become a narrower beam 330 when a receive array 300 collects signals reflected from a target 310. In this example, the transmit array has M identical elements 101-104 that each transmit the same single-element pattern 120 as shown in FIG. 1. The receive array has N elements, and FIG. 3 shows a first element 301, an $(N-1)^{th}$ element 304, and two intermediate elements 302 and 303. Each receive element collects radiation 311 reflected from the target by the stochastic beam of FIG. 1 once the target appears. An electronic feedback network 320 accepts the signals from each of the receive elements and provides input to each of the transmit elements.

The feedback network uses the complex signals reflected from the target and the known position of each of the receive elements to modify the re-transmitted radiation, introducing a large degree of correlation in the waveforms between neighboring elements of the transmit array. As a result, the re-transmitted beam 330 has an angular beamwidth 331 that is much narrower than the stochastic beam 111, 112, or 113 from the array in FIG. 1 or the beamwidth 120 from a single element of the array. FIG. 3 also shows that the re-transmitted radiation propagates in the direction opposite to the received radiation, so the overall transmit-receive process is retrodirective.

Figure 4:
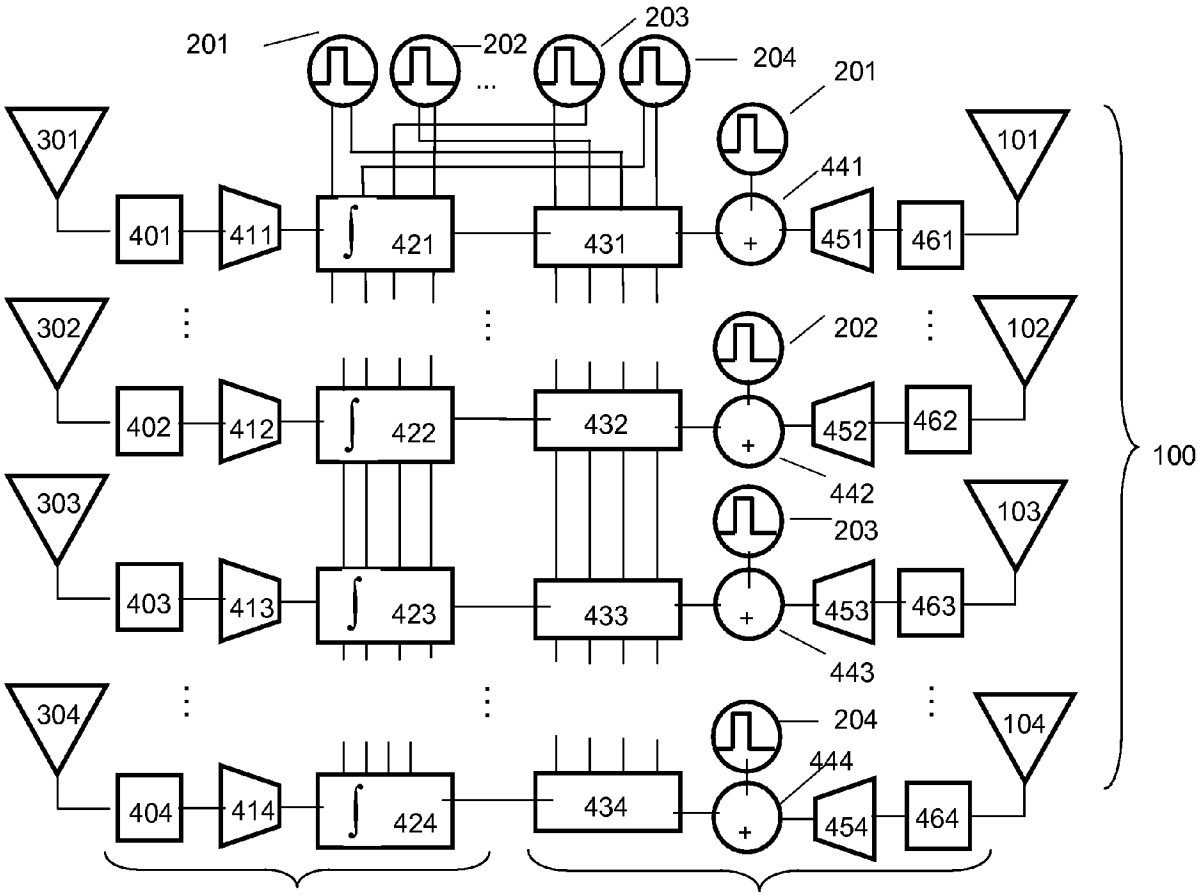
FIG. 4 is a functional block diagram of the system showing receive and transmit arrays, and the analog and digital electronic blocks necessary to realize the beam focusing behavior of FIG. 3, assuming that the number of transmit antenna elements M equals the number of receive antenna elements N.

A preferred methodology for the electronic feedback network 320 is represented by the block diagram of FIG. 4 which pertains to the special case where the number of transmit antenna elements M is equal to the number of receive antenna elements N. Each receive element is connected to a transmit element through an electronic "channel". Each channel consists of a receive section 470 and a transmit section 480, the combination of which has the necessary electronics and signal processing to realize the beam focusing behavior of FIG. 3.

The receive section 470 of FIG. 4 has the following electronic functionality. First, the PRM signals in each receive element 301-304 are down-converted to an intermediate frequency (IF) using the frequency down-conversion modules 401-404. The IF signals are then converted from analog to digital format and translated to baseband using mixed-signal and digital signal-processing electronics 411-414. Once translated to baseband, each of the N received signals is synchronously cross-correlated against all M transmitted PRM waveforms 201-204 using digital electronics 421-424. The result of the cross-correlation process is a set of complex correlation coefficients that are unique to each element of the receive array.

The transmit section 480 of FIG. 4 has the following electronic functionality. First, the complex correlation coefficients coming out of each receive section 421-424 are used to construct a feedback signal to the corresponding transmit section and associated antenna element. This signal is computed in a feedback calculator 431-434 consisting of digital logic electronics. The output from the calculator is a M-dimensional vector corresponding to the M unique PRM waveforms being transmitted and correlated against in the receive section. The output of the feedback calculator is then added to the unique digital PRM bitstream assigned to that channel using a digital summer 441-444. The combined digital waveform is then frequency-translated up to IF and converted to analog form using digital and mixed-signal electronics 451-454. Finally, it is frequency up-converted to RF using analog electronics 461-464 that also boost the RF signal strength enough to drive the antenna elements.

It is important to note that each of the receive-transmit channels in FIG. 4 act independently of all the neighboring channels in terms of transmitting a unique PRM waveform and receiving it. But the retrodirective functionality in the presence of a target requires two or more such channels to allow correlative feedback of subsequent transmissions to focus and steer the transmitted beam, and also allow coherent processing of the received signals to accurately determine target bearing. The accuracy in target bearing improves with the number of elements in the transmit and receive arrays.

Figure 5:
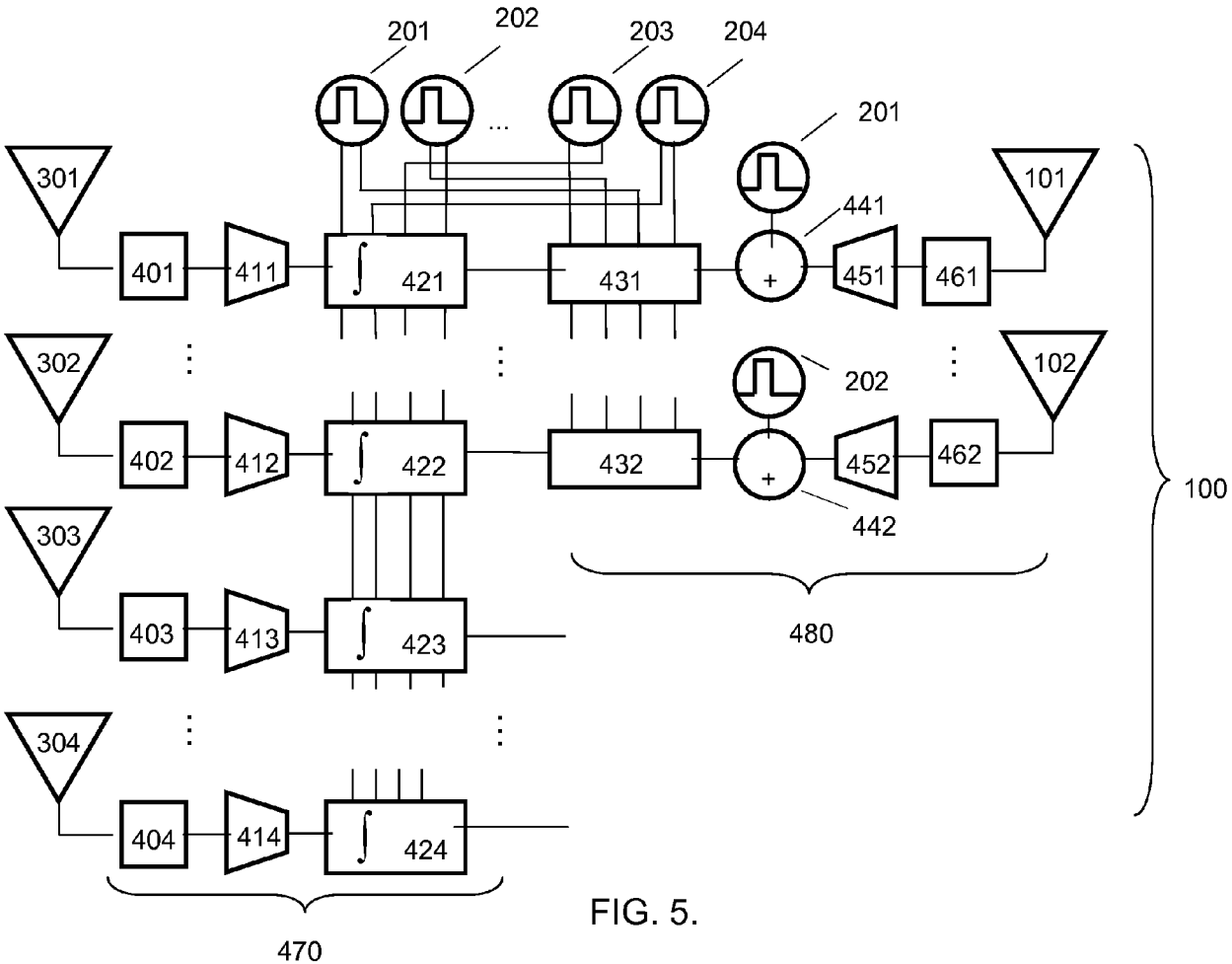
FIG. 5 is similar to FIG. 4 except that the number of receive elements is assumed to be less than the number of transmit elements, the one-to-one correspondence between a receive element and a transmit element through electronic channels still being evident.

FIG. 5 shows an alternative form of the preferred embodiment in which the number M of transmit antenna elements and associated electronic transmit sections is less than the number N of receive elements and associated electronic receive sections. Each of the sections has the same functionality as in FIG. 4, and there remains a one-to-one correspondence between a receive antenna element and a transmit antenna element. So N−M of the receive elements and corresponding channels are not used for feedback to the transmit array, but still yield correlation coefficients that can be used as the basis for target detection, range and angle measurement, and velocity estimation once the present invention is integrated into a working RF radar or other sensor system.

Figure 6:
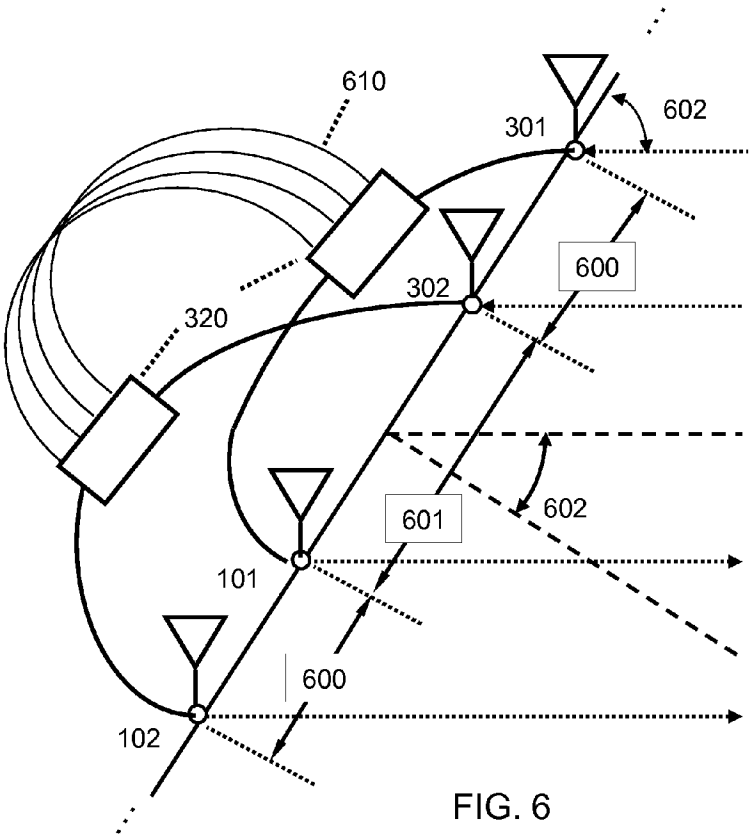
FIG. 6 provides a diagram of an antenna configuration according to a preferred embodiment of the present invention for which the electronics and signal processing of FIG. 4 will provide a signal at each transmit element of the antenna that is the complex conjugate of the signal received at the corresponding receive element of the antenna.

FIG. 6 provides a schematic diagram of an antenna configuration according to the preferred embodiment of the present invention for which the electronics and signal processing of FIG. 4 or 5 will provide a signal at each transmit element of the antenna that is the complex conjugate of the signal received at the corresponding receive element of the antenna. The transmit and receive elements both occupy a linear array with equal separation 600 between neighboring elements and a gap 601 between the transmit array and the receive array. Retrodirectivity is achieved because the feedback channel 320 computes the phase of the transmitted signal for each antenna element 301-302 as the complex conjugate of the phase of the signal in the corresponding receive elements 101-102. Such precise computation is made possible by the linear, cross-correlative signal processing in each channel described above and shown in FIGS. 4 and 5, and represented symbolically in FIG. 6 by the interconnects between channels 610. The magnitude of the transmitted signal will be a real number times the magnitude of the receive signal, the square of this real number representing the power gain. The configuration of FIG. 6 maintains retrodirective behavior for arbitrarily large angle-of-incidence 602 of the incident radiation, provided that the individual elements of the receive and transmit arrays have adequate radiative gain at this angle and for the given target radar cross section.

Figure 7:
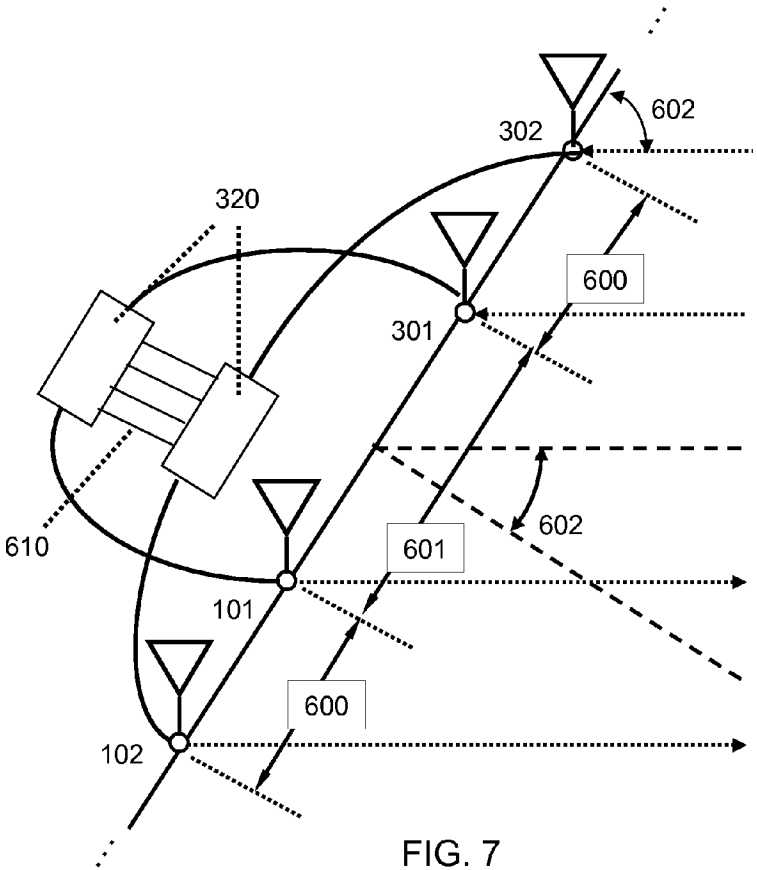
FIG. 7 provides a schematic diagram of an antenna configuration according to a preferred embodiment of the present invention for which the electronics and signal processing of FIG. 4 will provide a signal at each transmit element of the antenna that has the same phase as the signal received at the interconnected (i.e. corresponding) receive element of the antenna (e.g. using the van-Atta configuration).

FIG. 7 provides a schematic diagram of an antenna configuration according to a preferred embodiment of the present invention for which the electronics and signal processing of FIG. 4 or 5 will provide a signal at each transmit element of the antenna that has the same phase as the signal received at the corresponding receive element of the antenna (e.g. using the van-Atta configuration). As with antenna arrays of FIG. 6, the transmit and receive elements both occupy a linear array with equal separation 600 between neighboring elements and a gap 601 between the transmit array and the receive array. The difference between the configurations of FIGS. 6 and 7 is that in FIG. 6 the relative orientation of the receive elements is the same as that of the transmit elements, while in FIG. 7, the orientation is reversed. Retrodirectivity is achieved because the feedback channel 320 computes the phase of the re-transmitted signal for each transmit antenna element 101-104 as the product of a complex phase factor times the signal of the corresponding receive element 301-304. The phase factor is the same for all receive and transmit elements in the array.

Such precise computation in the system architecture of FIG. 6 or 7 is made possible by the linear, cross-correlative signal processing in each channel described above and shown in FIGS. 4 and 5, and represented symbolically in FIGS. 6 and 7 by the interconnects between channels 610.

Figure 8:
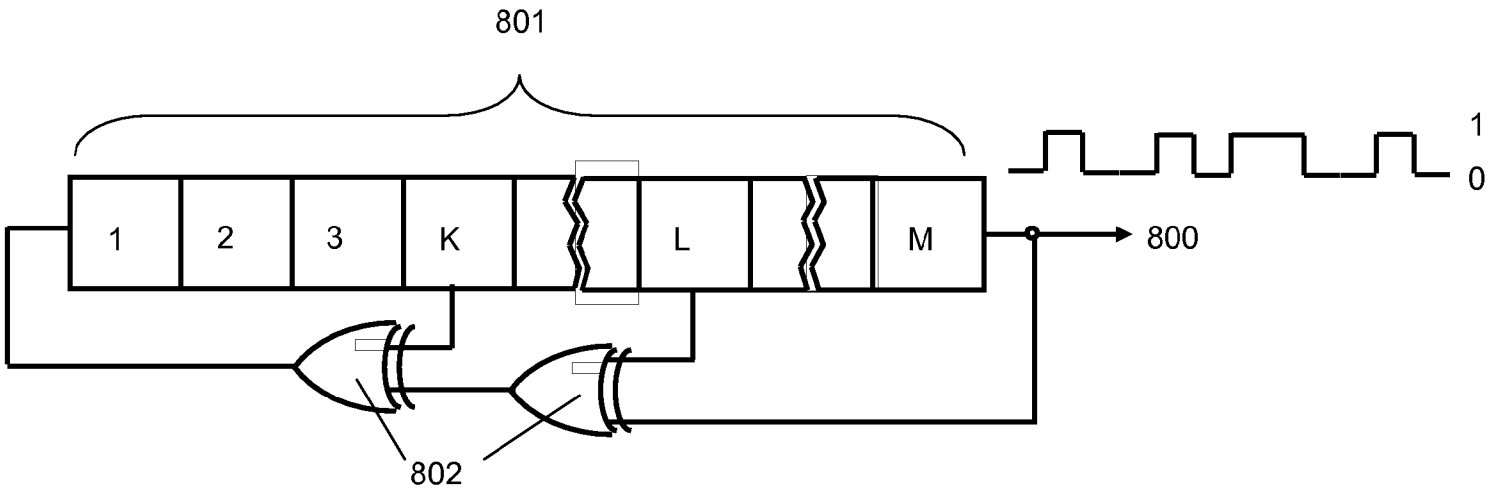
FIG. 8 provides a schematic diagram, according to a preferred embodiment of the invention, illustrating an example of a baseband technique for generating a preferred PRM waveform, for example a pseudorandom bit stream (PRBS), using a preferred means for generating which includes a linear feedback shift register.

FIG. 8 provides a schematic diagram, according to a preferred embodiment of the invention, illustrating an example of a baseband technique for generating a preferred PRM waveform, for example a pseudorandom bit stream (PRBS), using a preferred means for generating which includes a linear feedback shift register. The digital pseudorandom bit sequence, or PRBS 800, generated from a linear feedback shift register, or LFSR 801. The PRBS has maximal bit length $N_b$ consistent with the formula $N_b=2^M-1$ where M is the number of bits in the shift register as described in P. Horowitz, and W. Hill, "The Art of Electronics", Cambridge University Press, 1980. For the large number of bits anticipated for the present invention (M>10), multiple taps will be required to obtain maximum-length, quasi-orthogonal PRBSs, as shown in FIG. 8. In addition, exclusive OR gates, or modulo-2 adders 802 are required to accommodate the multiple taps and to make the feedback linear.

Figure 9:
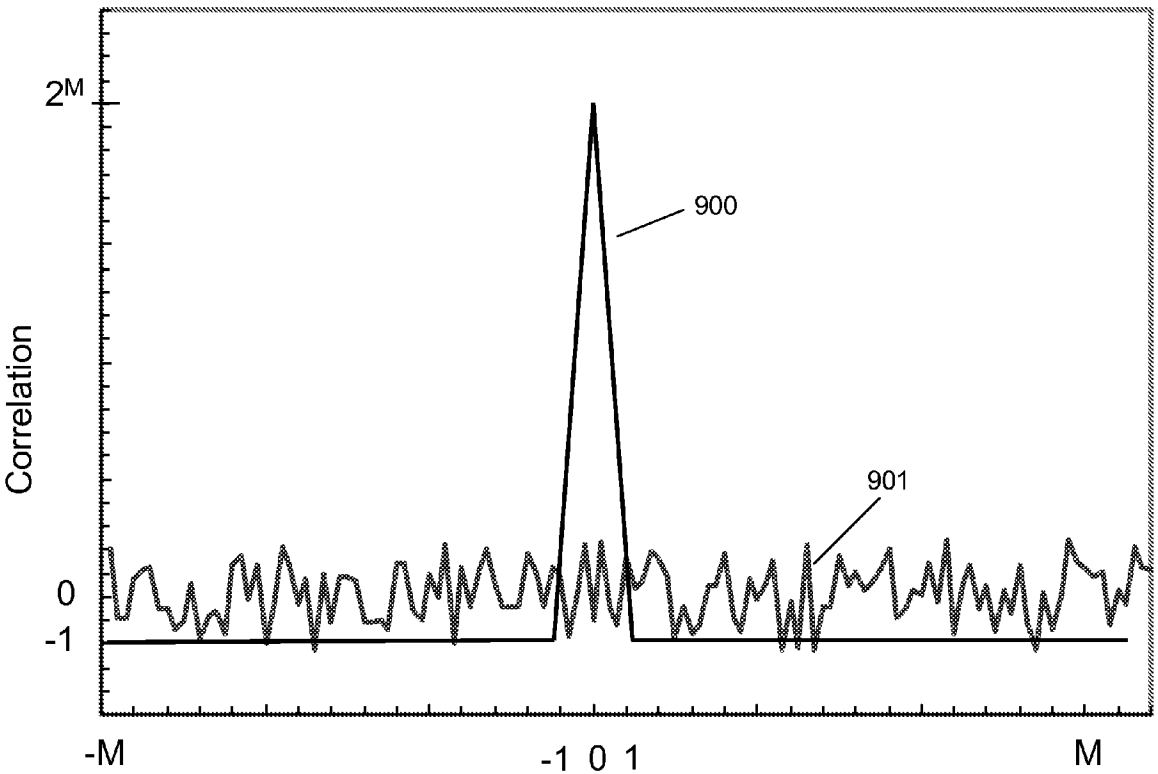
FIG. 9 provides an example plot of an autocorrelation function of a pseudorandom bit sequence (PRBS) as a function of time-offset in units of equivalent bits along with the cross correlation between two different, quasi-orthogonal PRBSs.

FIG. 9 provides an example plot of an autocorrelation function of a pseudorandom bit sequence (PRBS) as a function of time-offset in units of equivalent bits along with the cross correlation between two different, quasi-orthogonal PRBSs. The correlations and all other computation with the PRBS is carried out using a signed integer (i.e., non-return-to-zero, or NRZ), converting the 0 bit of FIG. 8 to −1 and the 1 bit of FIG. 8 to +1 as described in S. Haykin, "Communication Systems" 3rd Ed. (John Wiley, New York, 1994). When M is large and the time offset in the autocorrelation integral is zero, the autocorrelation 900 is $2^M-1$ as shown in FIG. 9. But when the offset is increased to a time corresponding to one or more bits of the PRBS, the autocorrelation drops to −1. The sharpness of the correlation peak is characteristic of a Kronecker delta function.

By contrast, if a given PRBS is cross-correlated against a second quasi-orthogonal PRBS as shown in FIG. 9, 901, the output never displays a large peak but instead fluctuates about zero with varying temporal offset as described by S. Haykin in "Communications Systems," 3rd edition, John Wiley, 1994, sec. 9.2. This is well-known behavior with PRBS sequences, and can limit the fidelity of the beam focusing and steering functions if the fluctuations become a significant fraction of $2^M$. However, for a sufficiently large number M of stages in the shift register of FIG. 8, there will exist some pairs of PRBSs for which the cross correlation is always much smaller than $2^M$, roughly 60 dB smaller on the vertical axis of FIG. 9.

Figure 10:
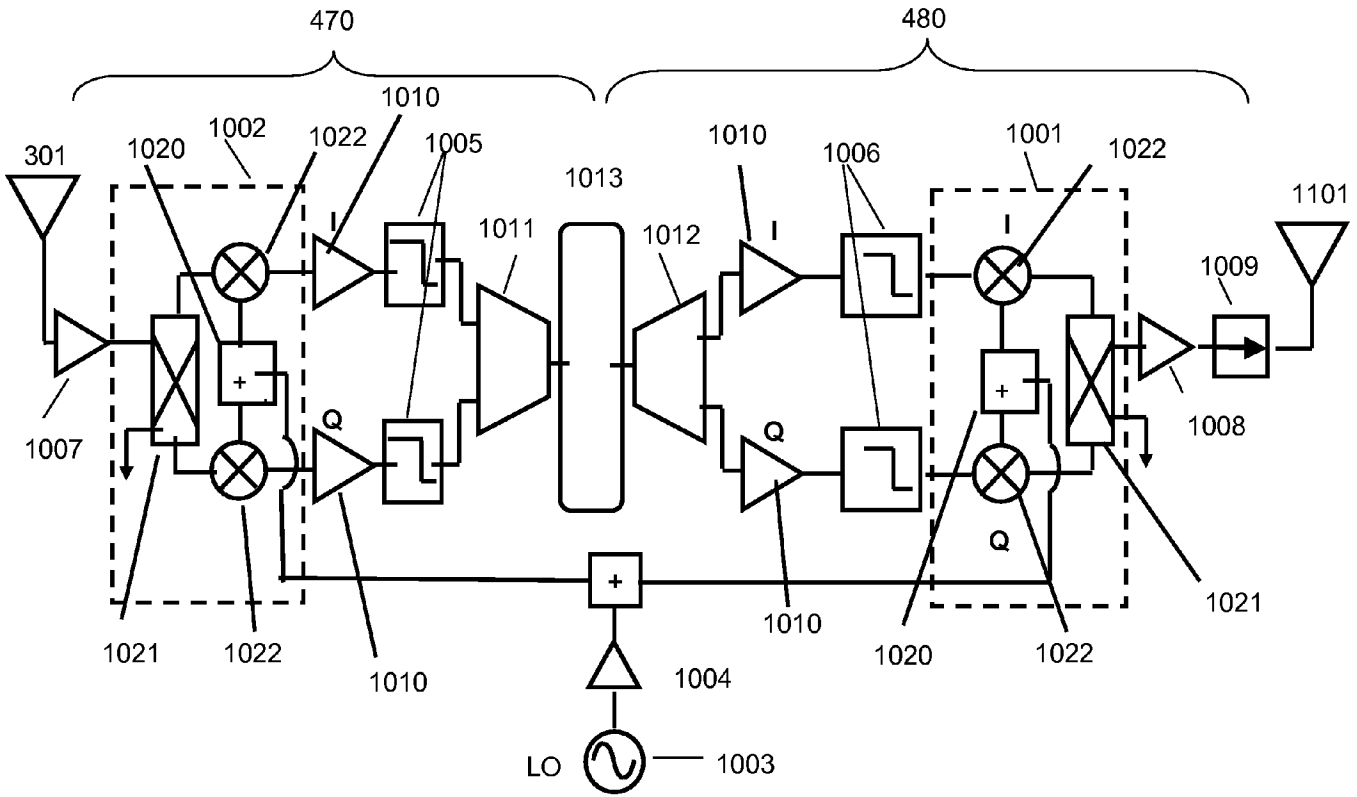
FIG. 10 provides a block diagram of a preferred arrangement of analog and digital electronics according to a preferred embodiment of the present invention to create PRM waveforms by frequency translating PRBSs from baseband to the IF band, up-converting to the RF passband using a local oscillator, and then reversing the process on the received RF PRM waveform.

FIG. 10 provides a block diagram of the specific analog and digital components in the receive and transmit electronic channels of FIGS. 4 and 5 according to a preferred embodiment of the present invention. At the heart of FIG. 10 is the digital-signal processing (DSP) component 1013. In this preferred embodiment, the DSP is carried out with a field-programmable gate array (FPGA). FPGAs are very useful at carrying out a variety of DSP functions including the generation of multiple quasi-orthogonal pseudorandom bit streams (PRBSs) as required by the present invention. In addition, FPGAs can carry out in real time the multitude of cross-correlations of such bit streams in each receive electronic channel. And FGPAs can rapidly carry out the digital filtering, frequency translation, complex conjugation, and other mathematical functions required in the present invention. In some alternative embodiments, it may be possible to replace FGPA implemented DSP methodology with certain application-specific integrated circuits (ASICs) or general purpose digital processors.

The arrangement in FIG. 10 creates PRM waveforms in the electronic transmit channel 480 by digitally translating PRBSs in frequency from baseband to an intermediate frequency (IF) band in the DSP electronics 1013, converting the IF digital signal to analog form using a multi-bit (8 bits or more) digital-to-analog converter (DAC) 1012. The in-phase (I) and quadrature (Q) outputs of the DAC are then amplified 1010 to suitable levels for analog processing and low-pass filtered 1006 to remove harmonics and spurs created by the digital electronics. Finally, the analog IF PRM waveform is frequency up-converted to the RF passband using a single-sideband suppressed-carrier (SSSC) upconverter 1001 and a solid-state local oscillator 1003.

In the receive electronic channel 470 the process is reversed, first frequency down-converting the received PRM waveforms from RF to IF using an SSSC downconverter 1002 and the same RF local oscillator 1003 as used in the upconversion process. The I and Q outputs of the downconverter are then amplified 1010 to suitable levels for digitization, and low-pass filtered 1005 to reduce the analog noise and act as anti-alias filters. Finally, the I and Q components are digitized using a multi-bit (8 bits or more) analog-to-digital converter (ADC) 1011, coupled to the DSP electronics 1013, and then frequency translated digitally to baseband.

To realize the SSSC function, both the upconverter 1001 and downconverter 1002 divide the LO power with a −3 dB, 0° power splitter, 1020, and drive two double-balanced mixers, 1022. In the SSSC downconverter the two mixers are fed from the two output ports of a −3 dB, 0/90° hybrid 1021 that divides the power from the receive antenna. In the SSSC upconverter, the two mixers are fed from the I and Q outputs of the DAC, and the outputs of the I and Q mixers are combined in a −3 dB, 0/90° hybrid 1021.

FIG. 10 shows how the SSSC operation and retrodirective radar operation can be achieved with one master local oscillator 1003. This is a benefit in all embodiments of the present invention because of common-mode rejection of the amplitude and phase noise of the LO. Any fluctuation in the amplitude or phase of the LO will occur simultaneously in the transmit carrier and on the receive carrier, so will be self-cancelling in the signal processing of the retrodirective feedback channel. In addition, this enables the use of a low-cost solid-state oscillator, such as the dielectric resonator oscillator (DRO) in the preferred embodiment. However to feed a large number of up- and downconverters, the DRO output will generally have to be amplified 1004 to a level of roughly +20 dBm or higher before being distributed as shown in FIG. 10.

FIG. 10 also shows an RF electronic feature of all embodiments of the invention to boost the strength of the incoming signal immediately after each receive antenna element using a linear, low-noise amplifier (LNA) 1007. The gain of this LNA should be great enough (roughly 20 dB or higher) to make the noise contribution from the following electronics insignificant with respect to the overall noise figure of the receiver. FIG. 10 also shows an RF power amplifier 1008 and isolator 1009, to boost the strength of the output signal to the level of roughly +30 dBm or higher, and protect the amplifier against reflections from the transmit antenna elements.

Figure 11:
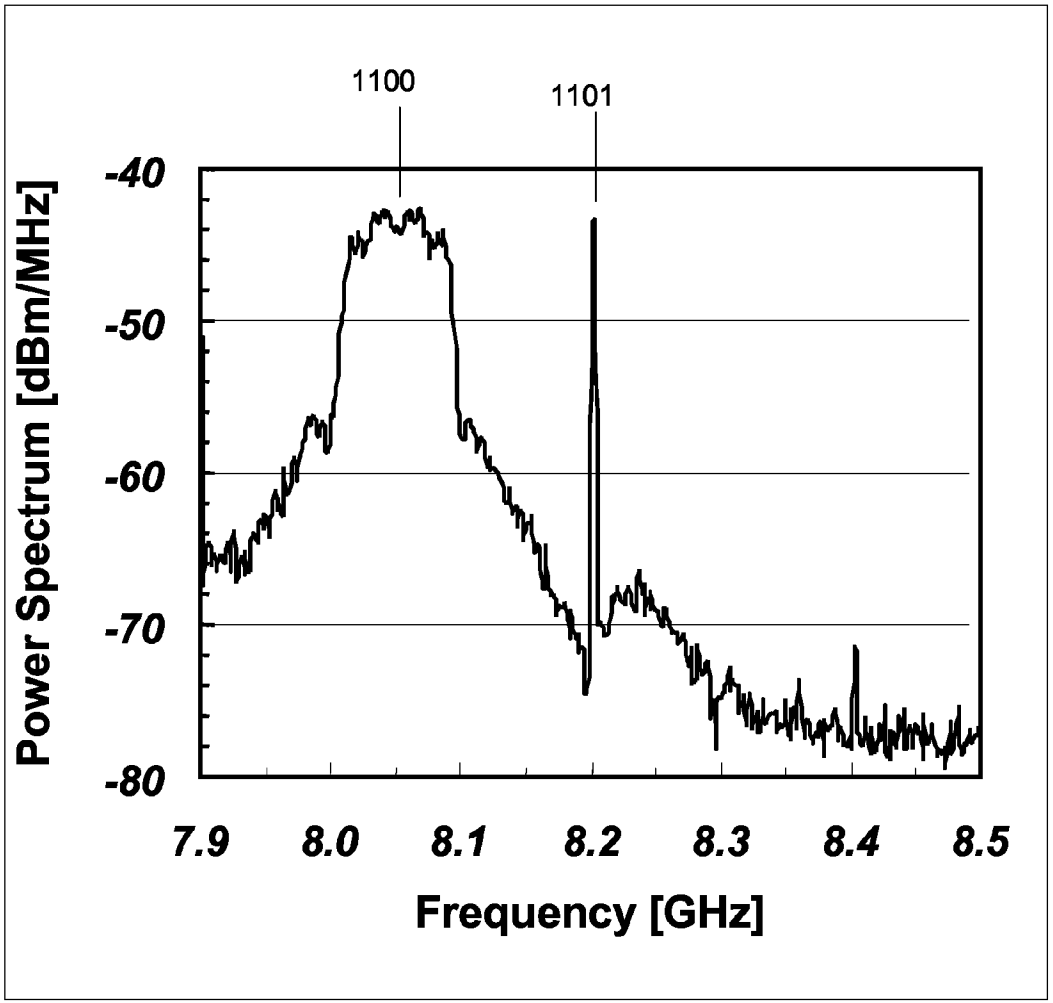
FIG. 11 provides a plot of power spectrum (dBm/MHz) versus frequency (GHz) obtained from proof-of-concept experiments using the preferred antenna configuration of FIG. 6 and the electronics of FIG. 10.

FIG. 11 provides a plot of power spectrum 1100 (dBm/MHz) versus frequency (GHz) obtained from proof-of-concept experiments using the preferred antenna configuration of FIG. 6 or 7 and the electronics of FIG. 10. It shows the power spectrum coming out of the SSPA of the architecture of FIG. 10 and under conditions of a 2047-lengh PRBS sequence being transmitted in a 100 MHz bandwidth centered 150 MHz below the 8.2 GHz (local oscillator) carrier frequency (1101). The total power in the PRBS sideband greatly exceeds the power in the carrier and the power in the opposite sideband, as expected for single-sideband, suppressed-carrier operation.

As noted above, embodiments of the invention may take a variety of forms some of which have been set forth herein in detail while others are described or summarized in a more cursory manner, while still others will be apparent to those of skill in the art upon review of the teachings herein though they are not explicitly set forth herein. Further embodiments may be formed from a combination of the various teachings explicitly set forth in the body of this application. Even further embodiments may be formed by combining the teachings set forth explicitly herein with teachings set forth in the various publications referenced herein, each of which is incorporated herein by reference. In view of the teachings herein, many further embodiments, alternatives in design and uses of the instant invention will be apparent to those of skill in the art. As such, it is not intended that the invention be limited to the particular illustrative embodiments, alternatives, and uses described above but instead that it be solely limited by the claims presented hereafter.

We claim:

1. A transmit and receive electromagnetic apparatus, comprises:

a transmit antenna array having at least one transmit element with each transmit element configured to transmit electromagnetic radiation into space, and a receive antenna array having a plurality of receive elements with specific locations relative to the at least one transmit element; and RF electronic components that drive each transmit element with a pseudorandom modulated (PRM) waveform that is generated at baseband frequencies by a digital phase shift keying (DPSK) function, translated to an intermediate frequency (IF) digitally, and imposed on an RF carrier by single-sideband frequency up-conversion using a solid-state local oscillator.

2. The apparatus of claim 1 wherein after each receive element, in an electronic receive channel, electronic components down-convert a received PRM waveform to an intermediate frequency band using a solid-state local oscillator, and then to the same baseband in which the digital PRM bit streams are generated to drive the transmit elements.

3. A transmit and receive electromagnetic apparatus, comprising:

transmit and receive antenna arrays with the transmit array having at least one transmit elements, each transmit element transmitting electromagnetic energy in a unique and quasi-orthogonal PRM waveform in the absence of a target, and wherein each transmit element has a corresponding receive element in the receive antenna array, each receive element collecting a portion of the electromagnetic energy reflected from any target, and wherein a spatial configuration exists between the transmit and receive antenna arrays whereby phase-preserving correlative signal processing between corresponding receive and transmit elements, using electronic components connecting corresponding receive and transmit elements, generates a re-transmission of electromagnetic energy from the transmit array that is retrodirective with respect to the electromagnetic energy reflected from the target to the receive array, and whereby the transmitted electromagnetic energy is steered automatically toward the target.

4. The apparatus of claim 3 wherein individual transmit and receive element pairs are located equidistant from and on opposite sides of a central point that is common to each pair of transmit and receive elements, so that retrodirective operation is achieved when the cross correlation is carried out linearly and coherently with preservation of amplitude and phase information such that transmitted energy by each transmit element is proportional to a received waveform at the corresponding receive element, the constant of proportionality being the same for all receive-transmit pairs.

5. The apparatus of claim 3 wherein PRM waveforms are stored in digital memory and the cross correlations are carried out digitally by a field-programmable gate array (FPGA).

6. The apparatus of claim 3 wherein after each receive element, in an electronic receive channel, electronic components down-convert a received PRM waveform to an intermediate frequency band using a solid state local oscillator, and then to the same baseband in which the PRM bit streams are generated to drive the transmit elements, wherein the PRM bit streams are digital.

7. The apparatus of claim 3 wherein a transmit element and a receive element of a transmit and receive pair have a spacing and orientation, wherein the spacing for each transmit and receive pair is substantially the same and the orientation of all transmit and receive pairs is substantially the same, and retrodirective operation is achieved when re-transmitted electromagnetic radiation from each transmit element is proportional to the complex conjugate of the signal corresponding to the reflected electromagnetic energy previously received by the respective receive element of each of the pairs of transmit and receive elements, whereby automatic pointing is achieved, at least in part.

8. The apparatus of claim 4 wherein in the presence of any target, the apparatus automatically focuses on the target and tracks the target in real time.

9. The apparatus of claim 3 wherein each receive and transmit element pair is interconnected through an electronic channel that generates complex feedback coefficients for the transmit elements by cross correlating a signal from each receive element against a set of at least one transmitted PRM waveform.

10. The apparatus of claim 7 wherein in the presence of any target, the apparatus automatically focuses on the target and tracks the target in real time.

11. The apparatus of claim 3 wherein the target is stationary.

12. The apparatus of claim 3 where the target is moving.

* * * * *